United States Patent [19]

Badger et al.

[11] Patent Number: 4,878,613

[45] Date of Patent: Nov. 7, 1989

[54] ENVELOPE FOR TABLE TOP LASER PRINTER

[75] Inventors: Ernest E. Badger, Buffalo Grove, Ill.; G. Russell Sornberger, Sanborn; Michael W. Anderson, West Seneca, both of N.Y.

[73] Assignee: Moore Business Forms, Grand Island, N.Y.

[21] Appl. No.: 346,334

[22] Filed: May 1, 1989

Related U.S. Application Data

[63] Continuation of Ser. No. 196,299, May 20, 1988, abandoned.

[51] Int. Cl.[4] ..... B65D 27/06

[52] U.S. Cl. ..... 229/75; 229/80

[58] Field of Search ..... 229/69, 68 R, 70, 75, 229/80

[56] References Cited

U.S. PATENT DOCUMENTS

| | | | |
|---|---|---|---|
| 1,800,143 | 4/1931 | Hughes | 229/80 |
| 2,367,440 | 1/1945 | Schieman | 229/80 |
| 2,722,369 | 11/1955 | Reuter | 229/69 |
| 2,824,685 | 2/1958 | Patton . | |
| 2,988,969 | 6/1961 | Stratton et al. . | |
| 3,026,018 | 3/1962 | Stratton et al. | 229/69 |
| 3,312,385 | 4/1967 | Amort . | |
| 3,411,699 | 11/1968 | Pine et al. | 229/69 |
| 3,952,942 | 4/1976 | O'Leary et al. | 229/73 |
| 3,990,627 | 11/1976 | Olson | 229/80 |
| 4,102,489 | 7/1978 | Lucas . | |
| 4,668,211 | 5/1987 | Lubotta et al. . | |
| 4,706,878 | 11/1987 | Lubotta et al. . | |

FOREIGN PATENT DOCUMENTS 0143622 6/1985 European Pat. Off. .

*Primary Examiner*—Frederick R. Schmidt
*Assistant Examiner*—Jack W. Lavinder
*Attorney, Agent, or Firm*—Nixon & Vanderhye

[57] ABSTRACT

Method and apparatus are provided for forming an envelope wherein front and rear panels of an envelope are incorporated in continuous or discrete webs or sheets. Heat activatable adhesive is applied to three peripheral edge portions of one of the envelope panels in facing engagement with the other of the panels. The webs or sheets are fixed together and fed into a printing machine such as a table or desk top laser printer wherein the heat fusing rolls of the printer are utilized to activate the heat activatable adhesive to thereby secure the envelope panels together to form an envelope pocket. One of the envelope panels incorporates a sealing flap portion which may be provided with a rewettable adhesive pattern, while the facing portion of the opposed sheet may be provided with an antistick composition to prevent premature sticking between the sheets in the area of the sealing flap.

8 Claims, 3 Drawing Sheets

ENVELOPE FOR TABLE TOP LASER PRINTER

This is a continuation of application Ser. No. 196,299, filed May 20, 1988, now abandoned.

BACKGROUND AND SUMMARY OF THE INVENTION

This invention relates to envelope constructions and, particularly, to envelope constructions for use with conventional table or desk top laser printers.

Presently, it is difficult for standard business envelopes to be fed into a table or desk top laser printer without the addition of a specially constructed envelope feed device. In addition, and even with this feed device, standard solid-pasted envelopes will pucker and/or wrinkle when processed through a laser printer as a result of the heat and pressure applied during the printing process.

The present invention solves these problems in a unique way by utilizing the heat fusing rolls of the laser printer, which are employed to fix the toner on the printed substrate, to activate a heat sealable or heat activatable adhesive provided about three peripheral borders of at least one of the envelope forming panels to seal the front and rear panels of the envelope along the borders to thereby form a conventional envelope pocket.

More specifically, in the present invention, a pair of sheets or webs (in discrete or continuous form) are superimposed and adhesively secured along a single leading edge thereof. The leading edge in this context refers to a forward edge relative to the direction of feeding. The upper and lower sheets or webs incorporate front and rear envelope panels with the front panel in direct overlying and vertically aligned relationship with the rear panel. It is also a feature of the invention that the envelope panels have at least two edges which coincide with corresponding edges of the web or sheet to minimize subsequent trimming to finished form.

The front panel of the envelope includes a foldable sealing panel portion which is provided on its rearward face with an adhesive, and preferably with a rewettable adhesive. Thus, in use, the sealing panel may be folded over the rear envelope panel and sealed in a conventional manner via application of moisture to the rewettable adhesive.

The rear sheet or web is provided on its front face with an antistick composition, and preferably a moisture barrier composition, directly underlying the rewettable adhesive on the superimposed foldable sealing panel to prevent accidental and unintended sticking of the sealing panel portion to the underlying sheet or web during production of the envelope.

At the same time, the envelope border portions, with the exception of the border defined by the foldable sealing flap portion, are provided with a heat activatable adhesive, applied in any conventional manner. The adhesive is preferably applied only to the front face of the rear panel, but may be applied additionally or alternatively to the rear face of the front panel.

To print and finalize the formation of the envelope construction, the superimposed webs or sheets are fed into a printing machine, such as a toner based table or desk top laser printer, with the sheets or webs adhered only along the forward leading edge extending across the sheets or webs, i.e., transverse to the direction of feeding.

After the envelope (typically only the front panel) has been printed with return address information and the like, the webs or sheets are passed between a pair of heat fusing rollers which not only fix the toner, but also activate the adhesive about the three peripheral borders of one of the envelope panels, so as to securely fasten one panel to the other and thereby form the envelope, including a pocket portion sealed on three sides and open on one side.

Subsequently, the individual envelopes are separated from the webs manually, or alternatively, webs or sheets may be fed into a trimming machine for removal of all or part of the web or sheet material lying outside the bounds of the envelope panels. The web portions which do not form part of the envelope per se, many also be printed and used as a voucher, invoice, or the like to be inserted in the envelope and mailed to a customer, client, etc.

In one exemplary embodiment, a standard size 10 business envelope may be oriented lengthwise of standard 8½" wide webs or sheets in such a way as to minimize the amount of paper required to be trimmed. In another exemplary embodiment, the envelope is oriented cross-wise to the longitudinally extending webs or sheets to form a smaller envelope in a manner that also minimizes trimming.

In either case, the webs or sheets may be in continuous or discrete form. If continuous, transverse lines of perforations extending across the webs or sheets may be employed to facilitate separation of the individual envelopes and, if appropriate, associated voucher, invoice, or the like. The separation may occur before or after, but preferably after the printing operation.

Accordingly, in its broader aspects, the invention relates to an envelope blank assembly which, in one exemplary embodiment, comprises a first sheet incorporating a front panel portion and foldable sealing flap portion of an envelope, superimposed and fixed to a second sheet incorporating a rear panel portion, wherein at least one of the first and second sheets has a heat activatable adhesive extending along three peripheral edges of one of the envelope panels, and engaging the other of the envelope panels. The foldable sealing flap portion of the envelope has a rewettable adhesive applied to its rearward face, while a corresponding portion of the second sheet lying directly beneath the foldable sealing flap portion has an antistick composition applied thereto.

The present invention also relates to a process of forming and printing an envelope comprising, broadly, the steps of (1) superimposing a pair of paper sheets, each of which incorporates an envelope panel portion, wherein one or more of the panel portions are provided with a heat activatable adhesive in predetermined border areas; and (2) passing the sheets through a printing device including heating means such that the heat activatable adhesive on the one or more panel portions is activated by the heating means during printing to secure the envelope panel portions together.

From the above, it will be appreciated that the present invention solves particular problems with respect to the ability and/or ease with which standard business envelope constructions can be printed by conventional toner-based table or desk top laser printers. The invention is particularly advantageous in that it reduces the number of steps required to form and print the envelope, and in that it enables envelopes to be printed in standard table or desk top laser printers without requiring specially designed feed devices heretofore required in the prior art to align and properly feed conventional envelopes.

Further objects and advantages of the invention will become apparent from the detailed description which follows.

DETAILED DESCRIPTION OF THE DRAWINGS

Figure 1:
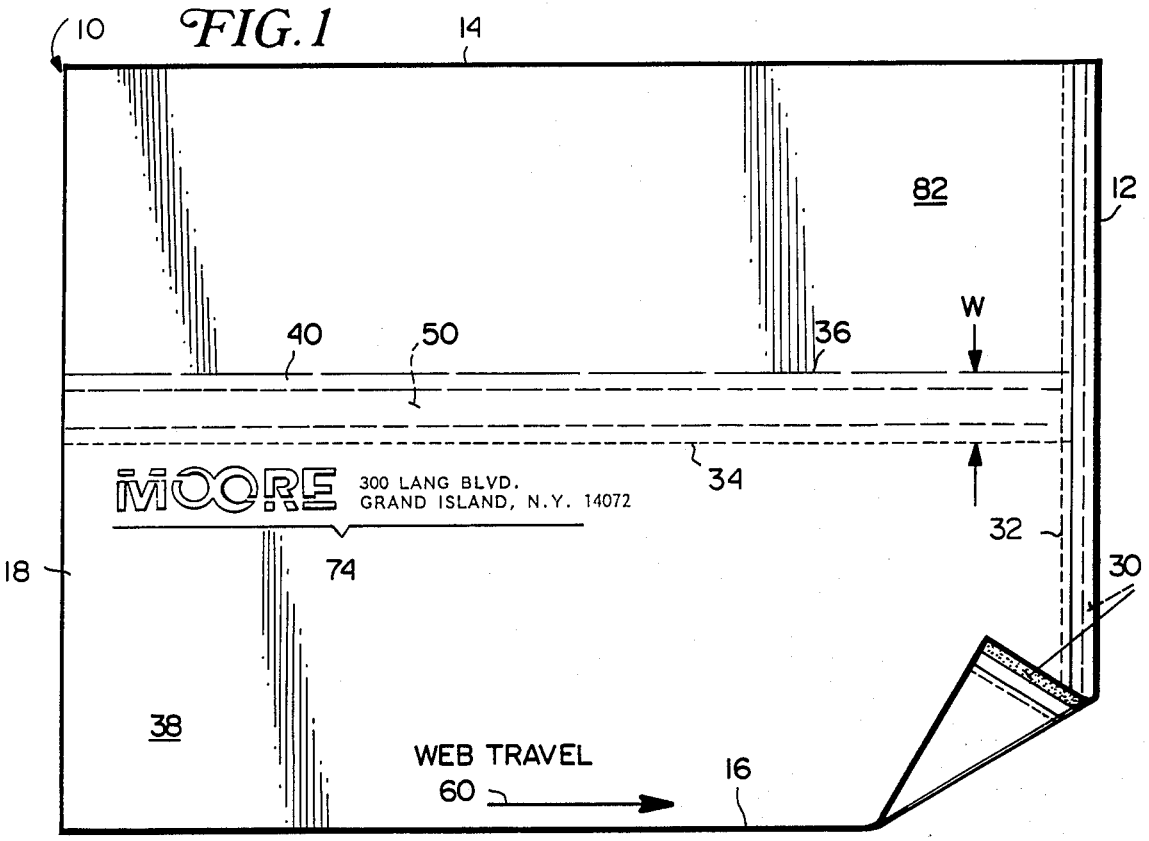
FIG. 1 illustrates a front envelope panel incorporated within a sheet or web in accordance with one exemplary embodiment of the invention.

Referring to FIG. 1, an upper sheet or web 10 of an envelope blank construction is shown, and includes a forward edge 12, a pair of side edges 14, 16 and a rearward edge 18.

Figure 2:
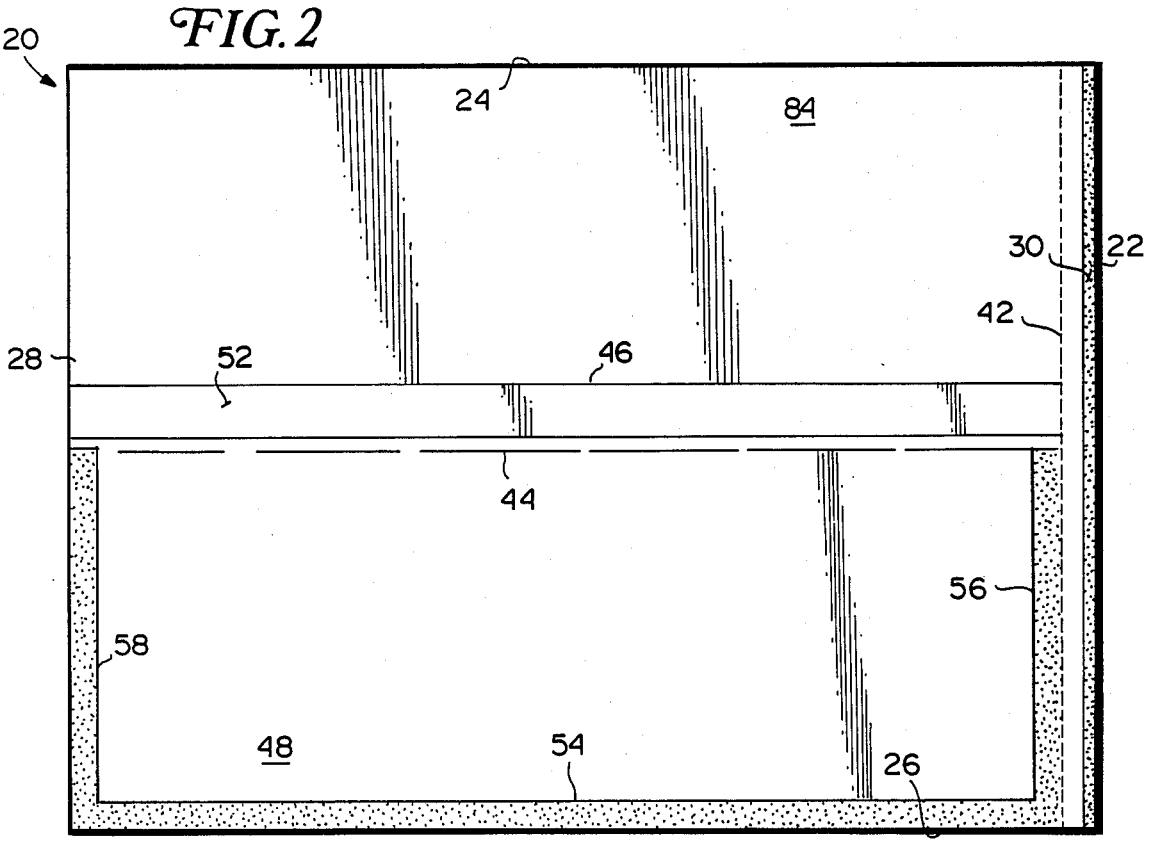
FIG. 2 illustrates a rear envelope panel incorporated within a sheet or web for use with the sheet or web shown in FIG. 1.

In FIG. 2, there is shown a lower sheet or web 20 of an envelope blank assembly, and including a forward edge 22, a pair of side edges 24, 26 and a rearward edge 28.

Sheets 10 and 20 are held together in superimposed relationship by a lines of adhesive 30 extending along the forward edge 12 of the rearward face of the upper sheet 10 and along the aligned forward edge 22 of the front face of the lower sheet 20. It will be appreciated, of course, that the adhesive 30 may be applied, alternatively, to only one of the upper and lower sheets. Adhesive 30 may be of any conventional type including, but not limited to, the pressure sensitive type. In either case, superimposed lines of perforations 32, 42, formed in sheets 10, 20, respectively, extend adjacent and inwardly of the adhesive 30. The lines of perforations 32, 42 permit separation of the adhesively secured forward peripheral edge portions of the upper and lower sheets upon completion of the printing/forming operation as will be described in greater detail below. As indicated above, in the event sheets 10 and 20 are in continuous form, a similar line of perforations (not shown) would extend along or adjacent the rearward edges 18, 28 to facilitate separation of the individual envelopes from the continuous sheets or webs.

The sheet 10 is also provided with a perforation line 34 extending between forward edge 12 and rearward edge 18 which serves as a line about which an envelope sealing flap, described below, may be folded in a conventional manner. The sheet 10 also includes a trim line 36 extending substantially parallel and spaced from the line of perforations 34. It will thus be appreciated that the sheet 10 incorporates a front panel 38 of an envelope defined by web edges 16 and 18, perforation line 32 and trim line 36. This front panel further includes a sealing flap portion 40, defined by lines 34 and 36, and foldable about the line of perforations 34.

Referring again to FIG. 2, the underlying or lower sheet 20 incorporates a rear panel 48 of an envelope, defined by edges 26, 28, a transverse perforation line 42 which underlies perforation line 32, and a trim line 44 which underlies the line of perforations 34 in the upper sheet 10.

Thus, it may be seen that trim lines 36 and 44 are offset by the width W of the sealing flap portion 40, so that flap 40 may be folded about line 34 and over the trim line 44 (ultimately the upper free edge) of the rear panel 48 in a conventional manner.

Trim lines 36 and 44 are preferably in the form of elongated perforations or slits to facilitate manual removal of the excess web portions which do not form part of the finished envelope.

It will be understood, of course, that other trimming methods may be employed, incorporating, for example, an automatic trimming machine.

With reference again to FIG. 1, it may be seen that the foldable sealing flap portion 40 is provided on its rearward face, i.e., the face that ultimately engages the rearward face of the rear panel 48 in the folded-over position, with an adhesive pattern 50, extending over substantially the entire flap portion. Adhesive 50 may be of a conventional rewettable type typically employed in envelope construction. One suitable adhesive of this type is a compounded synthetic resin emulsion produced by the Craig Adhesives Company and sold under the name Craigbond 3078S. Other suitable rewettable, or pressure sensitive adhesives may also be used.

With specific reference now to FIG. 2, it may be seen that the rearward face of flap portion 40, there is provided on the front face of lower sheet 20, a strip or pattern 52 of an antistick composition applied to prevent accidental and unintended sticking of the foldable sealing flap portion 40 to the lower sheet 20 during the printing and heat sealing processes.

The antistick composition is preferably of the moisture barrier type, and most preferably a vegetable based ink, such as that manufactured by Colorcon, Inc. and sold under the name NoTox TM . This is a non-toxic and contaminant free ink which may be ordered in several colors such as yellow, magenta, blue or black. This latter feature is advantageous inasmuch as certain color inks may be more desirable for use with variously colored envelope assemblies. Of course, it will be understood by those skilled in the art that other vegetable based inks with good moisture barrier characteristics may also be employed. In addition, if the adhesive pattern 50 comprises a pressure sensitive adhesive, the antistick composition may comprise a conventional release liner or coating.

The pattern 52 may extend from an upper edge 46 (substantially underlying trim line 36) to a line adjacent trim line 44, thus extending slightly above and below the adhesive pattern 50 to insure that sealing flap is not caused to adhere to any portion of sheet 20 during the entire envelope forming and printing production process.

The front face of lower sheet 20 is also provided with strips 54, 56 and 58 of heat activatable adhesive extending along edges 26, 28 and perforation line 42, within the confines of the rear panel 48 of the envelope construction. It will be appreciated that when panels 38 and 48 are heat sealed along adhesive lines 54, 56 and 58 during the printing operation, an open-ended envelope pocket will be formed which can be closed by sealing flap 40 in a conventional manner. While the strips 54, 56 and 58 are shown applied to the front face of the rear panel 48, they may also be applied to the rearward face of front panel 38.

The heat activatable adhesive may be a waxy hot melt adhesive particularly designed for preapplied heat seal applications, such as that described herein. One exemplary adhesive is sold by the H. B. Fuller Company as product No. HM-4199. Other heat activatable adhesives may also be used.

Figure 5:
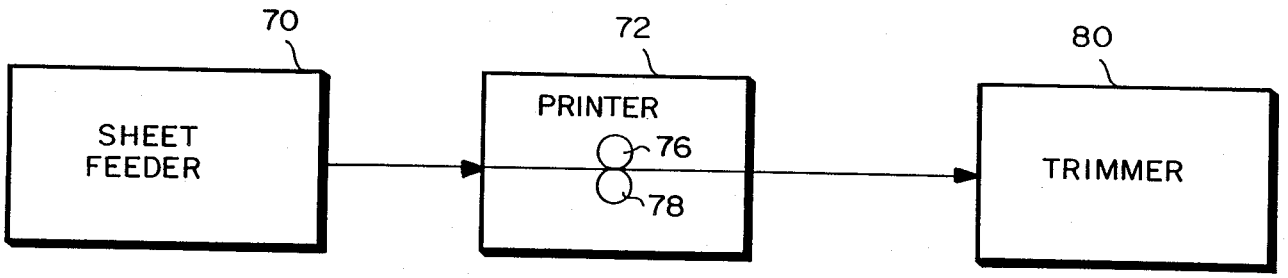
FIG. 5 is a schematic diagram illustrating an envelope printing and sealing process in accordance with the invention.

Turning to FIG. 5, a schematic diagram is presented which illustrates the sequence of events in a process according to an exemplary embodiment of the invention. Thus, sheet feeder 70 feeds a pair of superimposed sheets 10, 20 preferably in continuous web form and secured together only along the adhesive line 30 adjacent the leading edge 12 of each envelope construction, to a printer 72. In this regard, reference is made again to FIG. 1 showing the preferred feeding direction indicated by arrow 60 and noting that the adhesive line 30 extends transverse to the direction of feeding.

While the printer 72 schematically shown in FIG. 5 may be a conventional impact printer, the blank envelope assembly of this invention has been specifically designed for use with heat fusing toner based table or desk top printers, e.g., laser printers.

As the envelope blanks are fed through the printer, a business logo and/or address are printed, usually in the upper left hand portion of the front panel of each envelope (such as area 74 in FIG. 1). The continuous web then passes through heat fusing rolls, schematically indicated at 76, 78, which fix the toner and activate the heat sealable adhesive strips 54, 56, 58 in the border areas of each envelope to seal the front and rear panels so as to form an envelope pocket therebetween.

Thereafter, individual envelopes may be separated manually from the web by tearing along the perforation lines 32, 42 and trim lines 36 and 44. If in continuous form, an additional tear must be made along edges 18, 28. Alternatively, the web may be fed to a trimmer 80 which removes at least the leading edge portion (between lines 32, 42 and edges 12, 22) of each envelope construction. Further trimming along lines 36, 44 may be done here, or the separated but only partially trimmed envelopes may be shipped to the customer for final trimming. As indicated earlier, one (or both) of the web portions which do not form part of the envelope per se, such as shown at 82 and 84 in FIGS. 1 and 2, respectively, may be utilized as vouchers, invoices, or other inserts for use with the envelopes.

It will be appreciated by those skilled in the art that the envelope shown in FIGS. 1 and 2 represents a standard business envelope, formed within standard 8½" by 11" paper sheets, or sections of continuous sheets.

Figure 4:
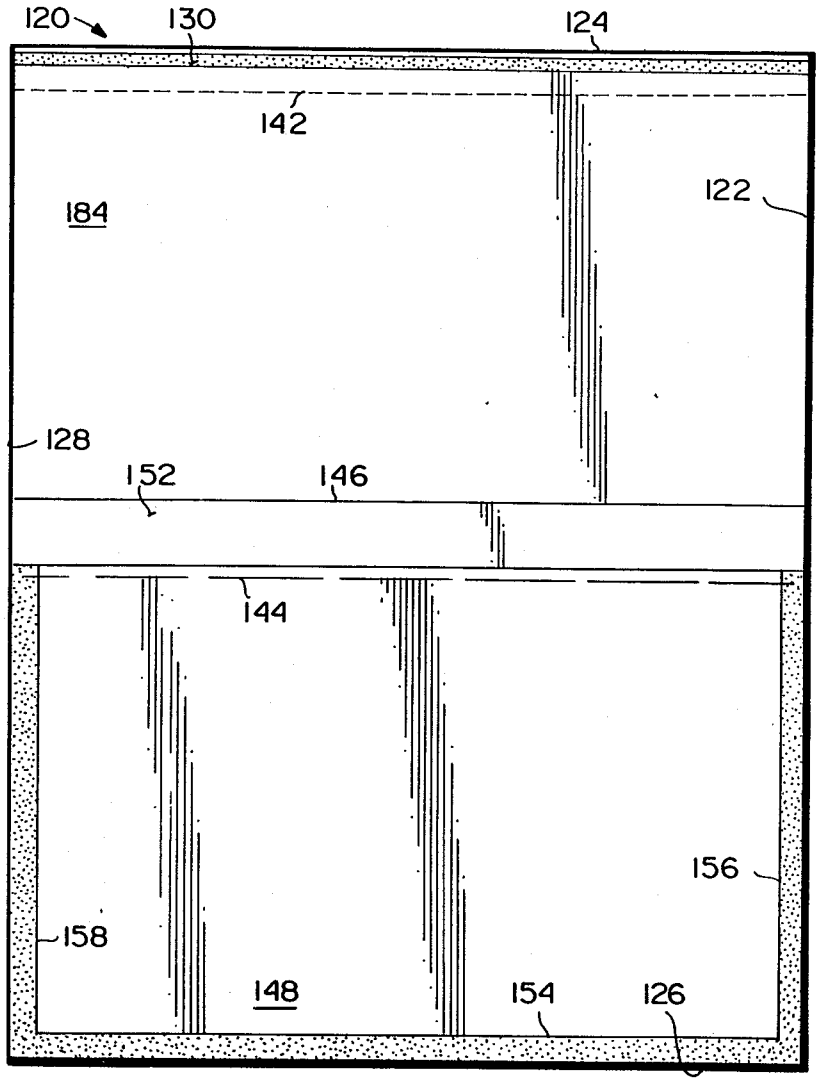
FIG. 4 illustrates a rear envelope panel incorporated within a sheet or web for use with the sheet or web shown in FIG. 3.
Figure 3:
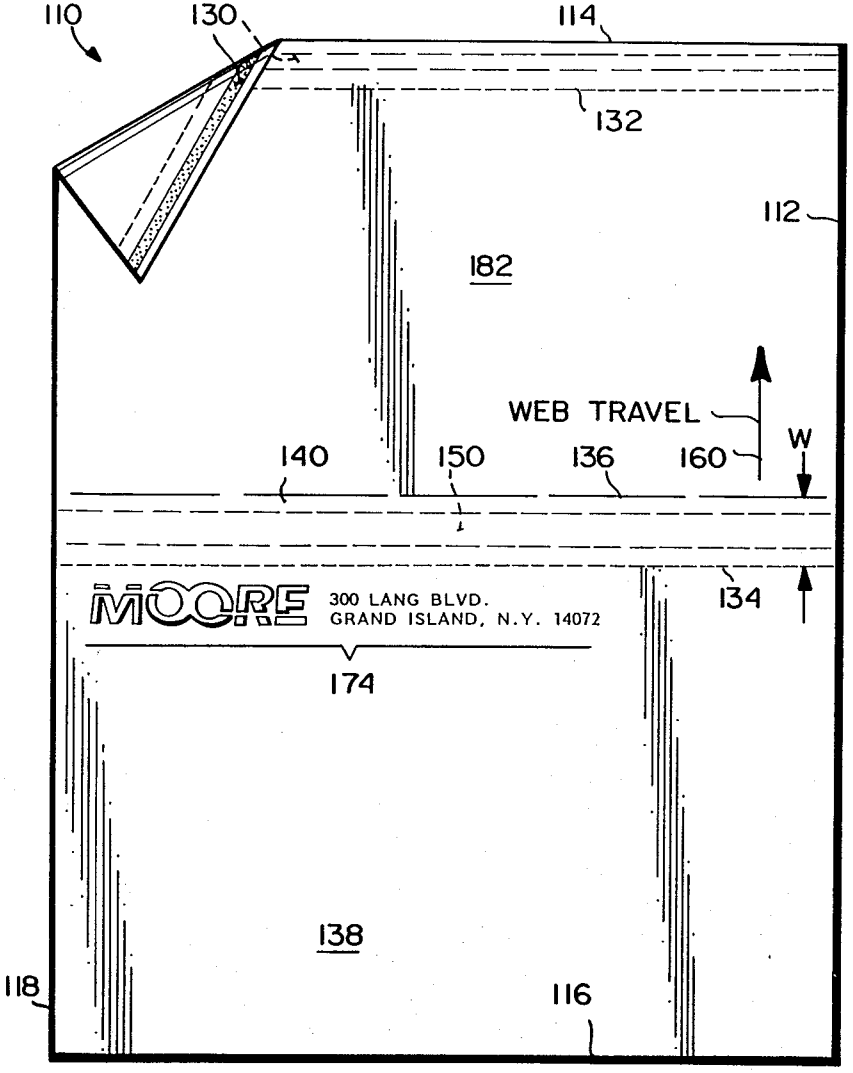
FIG. 3 illustrates a front envelope panel incorporated within a sheet or web in accordance with another exemplary embodiment of the invention.

With reference now to FIGS. 3 and 4, a second embodiment of the invention is illustrated wherein a smaller envelope construction is formed within similar sized sheets or webs.

The envelope construction illustrated in FIGS. 3 and 4 is identical in every respect with that illustrated in FIGS. 1 and 2 with the exception of size of the envelope and its orientation relative to the feeding direction of the webs or sheets. In this regard, reference numerals in FIGS. 3 and 4 are identical to those used in FIGS. 1 and 2, with the addition of a prefatory "1."Because of the identical construction, the embodiment shown in FIGS. 3 and 4 need not be described in detail. It is sufficient to indicate that the envelope has been reoriented relative to the webs or sheets 110, 120 so that the length dimension of the envelope extends transverse to the direction of feeding indicated by arrow 160, rather than parallel to the direction of feeding as in the case of the embodiment shown in FIGS. 1 and 2.

In both embodiments, the envelope orientation is such as to maximize the use of existing edges of the webs or sheets and thereby minimize the amount of final trimming required.

While only two envelope sizes and orientations have been described herein, it will be appreciated by those of ordinary skill in the art that other conventional, or customized envelopes may be formed in accordance with the invention.

It will therefore be appreciated that the present invention provides a unique solution to the problem of producing standard or other size envelopes that can be printed in heat fused toner based table or desk top laser printers without the addition of a special envelope feed device, and further provides manufacturing economies by reducing the number of both process steps and pieces of equipment required to form finished envelopes.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An envelope blank assembly for use in the production of envelopes printed by a non-impact type printer comprising:

a first sheet incorporating a front panel portion including a foldable sealing flap portion of an envelope superimposed on a second sheet incorporating a rear panel portion of said envelope, said first and second sheets being secured to each other along one edge only of said assembly;

at least one of said first and second sheets having a heat activatable adhesive extending along three peripheral edges of the respective envelope panel;

said foldable sealing flap portion of said front panel having a rewettable or pressure sensitive adhesive applied thereto, and a corresponding portion of said second sheet, lying directly beneath said foldable sealing flap portion, having an antistick composition applied thereto.

2. A blank construction according to claim 1 wherein, said one edge lies outside said envelope panels.

3. A blank construction according to claim 2 wherein at least one of said first and second sheets incorporates an insert for use with the envelope.

4. A blank construction according to claim 1 wherein said first and second sheets are fixed by a single line of adhesive lying outside adjacent superimposed lines of perforations which define one of said peripheral edges of said envelope panels.

5. A partially formed envelope for use with a non-impact printer, wherein heating means associated with said non-impact printer is utilized to complete the formation of said envelope, comprising:

a first sheet incorporating a front panel of the envelope;

a second sheet incorporating a rear panel of the envelope; wherein one of said first and second sheets is provided with a line of heat activatable adhesive along at least three sides thereof; and wherein, prior to printing, said first and second sheets are held together solely by a line of adhesive located outside the front and rear panels.

6. A partially formed envelope as defined in claim 5 wherein said first and second sheets are incorporated in a respective pair of continuous webs, each sheet being defined in part by lines of perforations extending transversely of the respective webs.

7. A partially formed envelope as defined in claim 5 wherein one of said first and second sheets incorporates an envelope insert to be printed by said non-impact printer.

8. A partially formed envelope as defined in claim 5 wherein said front panel includes a foldable sealing flap portion along a fourth edge, said sealing flap portion having a rewettable or pressure sensitive adhesive applied thereto, and wherein a portion of said rear panel lying directly underneath said rear panel lying directly underneath said sealing flap portion is provided with an antistick composition.

* * * * *